United States Patent [19]

Sato

[11] Patent Number: 4,727,222

[45] Date of Patent: Feb. 23, 1988

[54] FLEXIBLE SHIELDED COAXIAL CABLE

[75] Inventor: Shunichi Sato, Sakado, Japan

[73] Assignee: Junkosha Co., Ltd., Japan

[21] Appl. No.: 931,183

[22] Filed: Nov. 17, 1986

[30] Foreign Application Priority Data

Nov. 27, 1985 [JP] Japan ..... 60-182644[U]

[51] Int. Cl.[4] ..... H01B 7/34

[52] U.S. Cl. ..... 174/108; 174/36; 174/109

[58] Field of Search ..... 174/36, 108, 109; 333/243

[56] References Cited

U.S. PATENT DOCUMENTS 957,867 5/1910 Cobb ..... 174/109
1,880,060 9/1932 Wanamaker ..... 174/108
2,663,752 12/1953 Wier ..... 174/36
3,665,096 5/1972 Madle ..... 174/108 X
4,131,757 12/1978 Felkel ..... 174/108 X
4,440,973 4/1984 Hawkins ..... 174/36

*Primary Examiner*—Morris H. Nimmo
*Attorney, Agent, or Firm*—Mortenson & Uebler

[57] ABSTRACT

An improved flexible shielded electrical coaxial cable is provided having a shielding layer surrounding a core line, wherein the shielding layer comprises a plurality of metal wires helically overwrapped about the core line, adjacent wraps being in close contact, wherein the improvement comprises at least one strip interwoven in a stitching manner among the metal wires of the shielding layer. The strip is preferably a strip of expanded, porous polytetrafluoroethylene. The cable is highly flexible and useful in robots, for example.

3 Claims, 2 Drawing Figures

FLEXIBLE SHIELDED COAXIAL CABLE

BACKGROUND OF THE INVENTION

The present invention relates to flexible shielded wires such as coaxial cables or a variety of shielded electric wires or cables, which are made flexible by arranging conductive or ferromagnetic metal wires helically overwrapped about the outer circumference of the cable core, adjacent wires being in close contact.

Electric wires or cables of this kind are widely used in electronic devices and, more recently, have been molded into coil shapes. As a result, they are widely used for robots. Thus, it is desirable to have their flexing resistances and shielding capabilities maintained for extended periods of time.

Generally, the shielding layer of a shielded electric wire or cable has heretofore used either a tape of metal foil such as aluminum foil or a braided or closed conductor, as disclosed in Japanese Patent Laid-Open Publication No. 59-215608.

However, such shielded electric wire or cable using metal foil tape or the braided conductor as the shielding layer has certain disadvantages. In a case where it is repeatedly bent, the metal foil or braided conductor can be damaged causing the electric wire or cable not only to lose its shielding capacity but also to possibly short or cut its internal core line. Although the shielded electric wire or cable used as the closed conductor shielding layer initially is too flexible to directly cause the damage or the short, the shielding conductor wires may be offset, as the bending action continues, thereby losing the shielding capability.

In view of the aforementioned defects of the prior art, the present device has an object to provide a flexible shielded cable which is so flexible that it will not lose its shielding capability as it is repeatedly bent.

SUMMARY OF THE INVENTION

An improved flexible shielded electrical coaxial cable having a shielding layer surrounding a core line is provided, the shielding layer comprising a plurality of metal wires helically overwrapped about the core line, the wire in adjacent wraps being in close contact, wherein the improvement comprises at least one strip interwoven in a stitching manner among the metal wires of the shielding layer. The interwoven strip is preferably a strip of a low friction plastic material. The strip may be of an elastomeric material or a strip of porous, expanded polytetrafluoroethylene.

DETAILED DESCRIPTION OF THE INVENTION AND PREFERRED EMBODIMENTS WITH REFERENCE TO THE DRAWINGS

An improved flexible shielded electrical coaxial cable is provided having a shielding layer surrounding a core line, wherein the shielding layer comprises a plurality of metal wires helically overwrapped about the core line, adjacent wraps being in close contact, wherein the improvement comprises at least one strip interwoven in a stitching manner among the metal wires of the shielding layer. The strip is preferably a strip of expanded, porous polytetrafluoroethylene. The cable is highly flexible and useful in robots, for example.

According to the present invention, there is provided a flexible shielded cable which is constructed to include a shielding layer having a plurality of metal wires helically arranged in a closed manner on the outer circumference of a core line, wherein the improvement comprises at least one strip interwoven in a stitching manner among the metal wires of the shielding layer.

If the holding strip used in the above-specified construction is made of an extendible and contractible member such as an elastomer or a low friction material such as a fluorocarbon resin, it can advantageously hold the closed metal wires evenly without substantial lessening of the flexibility of the electric wire or cable.

Into the flexible shielding layer having the metal wires arranged in the closed contact manner, according to the present device the holding strips are arranged such that they are interleaved and interwoven in a stitching manner into the metal wires. This substantially eliminates offset and unevenness of the metal wires after the flexible shielded cable has been repeatedly bent.

Figure 1:
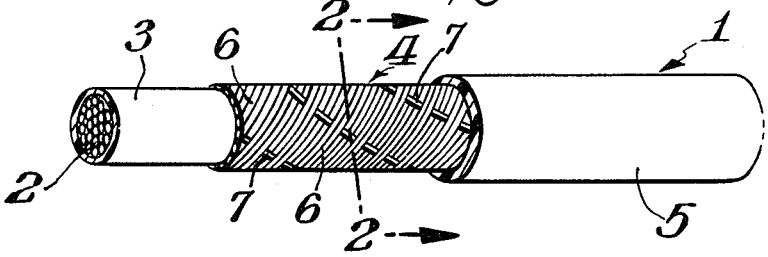
FIG. 1 is a perspective view, partly in cross-section, of an end portion of a flexible shielded cable according to one embodiment of the present invention.

In the drawings, FIG. 1 is an explanatory perspective view showing the end portion, partly in cross-section, of a flexible shielded cable 1 according to one embodiment of the present invention.

The flexible shielded cable 1 according to this embodiment is constructed such that a core line 2 composed of a plurality of insulated electric lines has its outer circumference sheathed by a protective plastic insulator 3 and having shielding layer 4 which in turn is sheathed with a resin sheath 5.

The shielding layer 4 comprises a plurality of metal wires 6 helically overwrapped over insulation 3, adjacent wires being in close contact. Holding strips 7 are interwoven with the metal wires 6 as shown. These holding strips 7 are preferably arranged to be helically stitched into every three or twenty metal wires 6, for example.

As a result, the metal wires 6 arranged on the outer circumference of the core line insulation 3 are held uniformly in a form of chord fabric.

This substantially prevents the shielding layer 4 from having its metal wires 6 offset, even if the cable is bent or exposed to a twisting force, so that it holds its uniform shielding capacity.

If the holding strips 7 used in the shielding layer 4 are made of expanded and sintered polytetrafluoroethylene having low friction characteristics, they will not substantially lessen the flexibility of the cable. Even if the holding strips 7 are made of an extendible and contractible materials such as an elastomer, the flexibility of the shielded cable 1 can be maintained at a satisfactory level.

Figure 2:
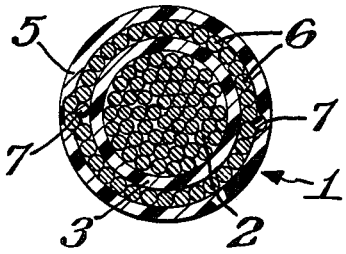
FIG. 2 is a cross-sectional view of the cable taken along line 2—2 of FIG. 1.

FIG. 2 shows a cross-section of the cable 1 taken along line 2—2 of FIG. 1. Therein the core 2 is overwrapped with insulation 3 which in turn is covered by wires 6 having strips 7 interwoven among the wires 6. The entire assembly is protected by cover 5.

The present invention should not be limited to the embodiment described above but can naturally be modified in various manners within the scope of the spirit thereof such that a plurality of shielding layers are overlapped or separated to enhance the shielding capacity, such that the core line is composed of optical fiber wires or such that the holding strips are made of arbitrary threads.

As has been described above, according to the present invention, a flexible shielded cable is constructed to include a shielding layer having metal wires arranged in the closed manner on the outer circumference of the core line insulation, wherein the improvement comprises at least one strip interwoven in a stitching manner among the metal wires of the shielding layer. As a result, the closed metal wires are evenly held on the outer circumference of the core line insulation while maintaining satisfactory flexibility. As a result, it is possible to provide a shielded cable which has excellent flexibility and its shielding capacity does not decrease substantially even after it has been repeatedly bent.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An improved flexible shielded electrical coaxial cable having a shielding layer surrounding a core line, wherein said shielding layer comprises a plurality of metal wires helically overwrapped about said core line, adjacent wraps of metal wires being in close contact, wherein the improvement comprises at least one strip of a low friction plastic material interwoven in a stitching manner among said metal wires of said shielding layer.

2. The cable of claim 1 wherein said strip is a strip of an elastomeric material.

3. The cable of claim 1 wherein said strip is a strip of porous, expanded polytetrafluoroethylene.

* * * * *